United States Patent [19]

Lutes

[11] 4,384,795

[45] May 24, 1983

[54] STANDARDIZED INTERFACE FOR ACOUSTIC BAR TYPEWRITERS

[76] Inventor: Bill N. Lutes, 3637 Pine Ave., Long Beach, Calif. 90807

[21] Appl. No.: 294,468

[22] Filed: Aug. 20, 1981

[51] Int. Cl.[3] ..... B41J 5/30

[52] U.S. Cl. ..... 400/77; 400/86; 400/477; 400/479; 340/365 R

[58] Field of Search ..... 400/77, 86, 472, 477, 400/478, 479; 340/347 R, 347 DD, 365 R, 365 A, 365 S; 178/17 R, 17 C, 27, 33 R; 179/110 A; 333/141; 310/317, 319, 328, 330, 334; 365/157; 367/137

[56] References Cited

U.S. PATENT DOCUMENTS

| | | | |
|---|---|---|---|
| 2,838,993 | 6/1958 | Hinrichs | 400/86 X |
| 3,390,334 | 6/1968 | Forward | 310/328 X |
| 3,647,962 | 3/1972 | Whetstone | 178/17 C |
| 3,649,856 | 3/1972 | O'Neill | 310/328 |
| 3,725,908 | 4/1973 | Brisebarre et al. | 310/319 X |
| 3,810,154 | 5/1974 | Briant | 340/347 DD |
| 3,947,708 | 3/1976 | Fulenwider | 340/347 R X |
| 4,027,280 | 5/1977 | Beyers, Jr. | 367/137 |
| 4,258,356 | 3/1981 | Jalbert | 400/479 X |
| 4,311,991 | 1/1982 | Rimbey | 310/334 X |

FOREIGN PATENT DOCUMENTS

| | | | |
|---|---|---|---|
| 2850190 | 5/1979 | Fed. Rep. of Germany | 400/477 |
| 1386070 | 3/1975 | United Kingdom | 340/365 S |

OTHER PUBLICATIONS

IBM Technical Disclosure Bulletin, "Ripple-Sensing Keyboard," Arosenius, vol. 14, No. 10, Mar. 1972, p. 3199, 340-365 A.

IBM Technical Disclosure Bulletin, "Electronic Keyboard," Lisk, vol. 20, No. 1, Jun. 1977, p. 259.

*Primary Examiner*—Ernest T. Wright, Jr.

*Attorney, Agent, or Firm*—I. Michael Bak-Boychuk

[57] ABSTRACT

An interface for converting standard computer character code, in either serial or parallel form, into a sequence of simulated acoustic wave pattern signals. These wave pattern signals are then applied to an acoustic bar operated typewriter, like the typewriter sold under the mark "Typetronic" by the SCM Corporation, duplicating the acoustic wave fronts that are generated by the keyboard. Thus the typewriter is conformed to operate as a data processing printer without any reduction in the functions thereof.

4 Claims, 3 Drawing Figures

STANDARDIZED INTERFACE FOR ACOUSTIC BAR TYPEWRITERS

BACKGROUND OF THE INVENTION

1. Field of the Invention

The present invention relates to data processing systems, and more particularly to the adaptation of an acoustic bar typewriter for use as a data processing printer.

2. Description of the Prior Art

In the recent past the SCM Corporation has put forth on the market a typewriter sold under the trademark "Typetronic," which includes an acoustic bar against which the typewriter keys are struck. The acoustic wave generated by each key strike then propagates to the two ends of the bar and is compared thereat both for the time of arrival and for its phase. The arrival differences and phase are then utilized to determine the position of the keys making the strike and can therefore be converted to the control signals for the print cycle.

The advantages of the foregoing typewriter are manyfold. Of primary advantage is the result that very elaborate mechanical and electrical arrangements for each key are avoided. There is, however, a disadvantage in that the resulting electrical signals are real time based and are not conveniently adapted to the computer character code used in the art. For example, it is the common practice in the art to use ASCII or similar binary code for alphabetic character encoding commonly designated either as the IEEE488 or the RS232 encoding scheme. These coding schemes, being referenced to the cycle rate of a data processing device, do not conveniently provide the necessary time apertures for controlling the SCM Typetronic typewriter.

It is therefore the intent of the present invention to provide an interface through which the conventional or commonly practiced codes are converted to a signal sequence simulating the acoustic signal propagation through the acoustic bar.

SUMMARY OF THE INVENTION

Accordingly, it is the general purpose and object of the present invention to provide an interface by which alphabetic code generated in a data processing device is converted to real time signals for duplicating an acoustically based typewriter signal.

Other objects of the invention are to adapt a data processing device to an acoustically based printer configuration.

Briefly these and other objects are accomplished within the present invention by loading the character codes, whether serial or parallel, of a data processing device one by one into an encoder ROM. The encoder ROM then provides a bit code simulating the time interval between the wave front arrivals at the end of the bar and the phase or arrival polarity. The time bit count is then applied to the preset terminals of a counter which is then unloaded at the clock rate of the typewriter. Concurrently, the phase code is applied to a set of gates which together with the clock output from the counter provides the necessary signal configuration which duplicates the acoustic bar.

In addition to the foregoing feature there are various housekeeping functions which confirm the communication between the data processing device and the typewriter and maintain coherence order thereover. For example, the Typetronic typewriter is provided with an LSI chip conformed to receive a right polarity and a left polarity signal separated by a predetermined time interval. Based on the arrival time of these signals this LSI chip selects the particular character to be printed. Should the key stroke rate exceed the print rate this same LSI chip includes a fifo stack which may then produce a fifo empty signal indicating that the interface is ready to accept additional characters. In addition, various checks for valid data or error checks may be carried out within this housekeeping function.

By virtue of this arrangement of parts a signal configuration is produced at the interface output which is an equivalent to the signal functions produced by the acoustic bar. In addition the interface provides the necessary control for adapting the output rate of the data processing device to the time based output rate of the acoustic bar. Thus all of the benefits of the foregoing typewriter are retained while adapting thereof to standardized codes for operation as a printer.

DESCRIPTION OF THE SPECIFIC EMBODIMENT

Figure 1:
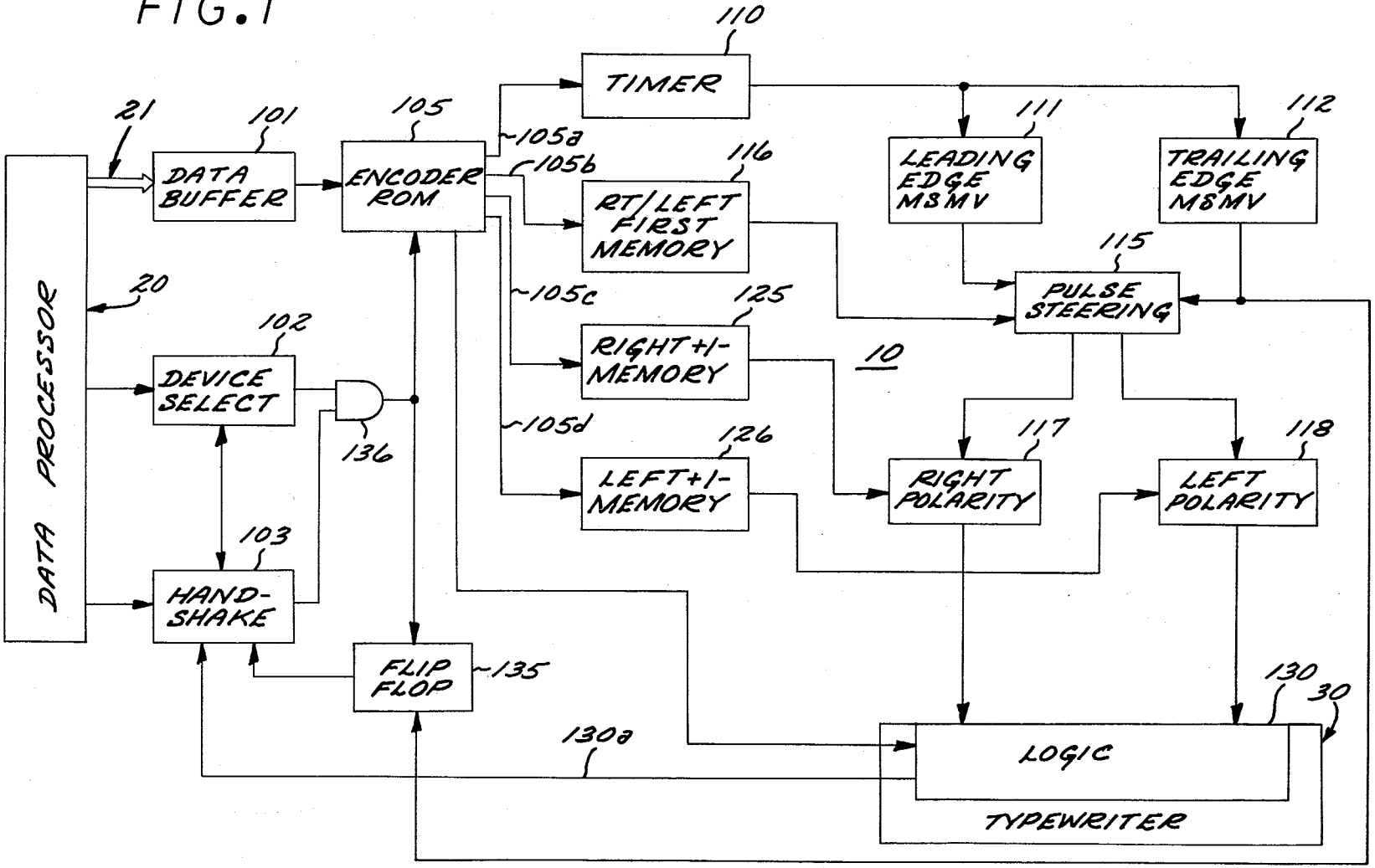
FIG. 1 is a block diagram of an interface constructed according to the present invention.

As shown in FIG. 1 an interface system, generally designated by the numeral 10, is interposed between a data processing device like the data processor made by the Commodore Corporation under the trademark "PET" designated by the numeral 20, and the SCM "Typetronic" typewriter designated by the numeral 30. This interface unit 10 connects to the data bus 21 of the processor 20 by way of a data buffer 101 which is constantly exposed to the eight bit wide data stream on the bus 21. Concurrently the data processor 20 provides the necessary I/O command lines to select the particular device and if the lines are properly coded the interface 10 is selected. This is done by a device select stage 102 which generically operates as an address filter, constantly searching for the appropriate code designating this device. The device select stage 102 furthermore, is tied to a hand shake stage 103, further connected to a set of control lines from the data processor 20 and control lines issued by the typewriter 30. It is this last stage 103 that effectively establishes communication between the typewriter 30 and the data processor 20, verifying the efficacy of the data sent and establishing whether data has been accepted or not based on the timing differences between the typewriter 30 and the data processor 20.

The data buffer 101 then unloades its data into an encoder ROM 105 which converts the ASCII or any other standardized code into four signal groupings. More specifically, the first signal grouping coming out of encoder ROM 105 is a time aperture code **105*a*, the second signal group comprising a right/left first code 105*b*, the third signal group 105*c* establishing whether the right end wave front is either positive or negative and the fourth, 105*d*, establishing whether the left wave front within the tone bar is positive or negative. Thus these four signal branches 105*a*, 105*b*, 105*c* and 105*d* out of the encoder ROM 105 provide the time aperture between the emulated arrival of the two wave fronts to the end of the tone or the acoustic bar (not shown) of the typewriter by the time count of signal 105***a*, with the signal branch 105*b* establishing which side of the bar will have the wave front first and the phase angle of the wave front being established by signal branches 105*c* and 105*d*, i.e. whether it is compression or rarification. Between these signal branches 105*a*, 105*b*, 105*c* and 105*d* all of the discernable data from the acoustic bar is fully duplicated at a clock rate established by the typewriter 30. More specifically, signal branch 105*a* is applied to a timer 110 generally configured as a counter which is then advanced by the system clock of the typewriter 30. This timer 110 produces a square wave of a length determined by the time code in the encoder ROM 105, applying the square wave to a leading edge monostable multivibrator 111 and to a trailing edge monostable multivibrator 112. Multivibrators 111 and 112 provide the leading and trailing edge pulses to a pulse steering stage 115 which is controlled by the right/left first signal branch 105*b*. In particular, signal 105*b* is applied to a right/left first memory stage 116 which then produces the appropriate control signals to the pulse steering stage 115. The pulse steering stage 115 provides two signal outputs respectively to a right polarity gate 117 and a left polarity gate 118. These, in turn, are controlled by the signal branches 105*c* and 105*d* through corresponding right polarity memory 125 and left polarity memory 126.

It is to be understood that the SCM Typetronic typewriter, designated herein by the numeral 30, is provided with its own digital logic embodied in a single LSI chip designated herein as chip 130. Alternatively, one may take reference to the teachings of U.S. Pat. No. 4,258,356 to Jalbert or U.S. Pat. No. 4,311,911 to Rimbey, both assigned to S.C.M., which include a logic unit, a system clock and a first-in-first-out (FIFO) storage arrangement, embodied herein as the chip 130. Within that chip 130, according to the various brochures and maintenance manuals available from the manufacturer, is included a first in, first out fifo stack producing a signal 130*a* which is applied to the handshake stage 103. Concurrently, the pulse from the trailing edge one shot or monostable multivibrator 112 is applied to a flip-flop stage 135 which also collects the output from an AND gate 136 collecting at its input the outputs of the device select stage 102 and the handshake stage 103. Gate 136, furthermore, applies its output to the encoder ROM 105. Thus the state of the flip-flop stage 135 determines whether the timing aperture entailed in designating a print character has expired and is therefore indicative of the character execution sequence. This signal is then applied, once again, to the handshake stage 103 to be combined with the fifo signal from the LSI chip 130. Accordingly, as the fifo stack is sequentially cleared in the course of execution of the print sequence, additional character data is accepted into the interface 10. Thus the data rate mismatch normally entailed between a mechanically operated device like the typewriter 30 and the electronic data processor 20 is accomodated in a signal configuration which fully duplicate the acoustic mechanics in the acoustic bar.

Figure 2:
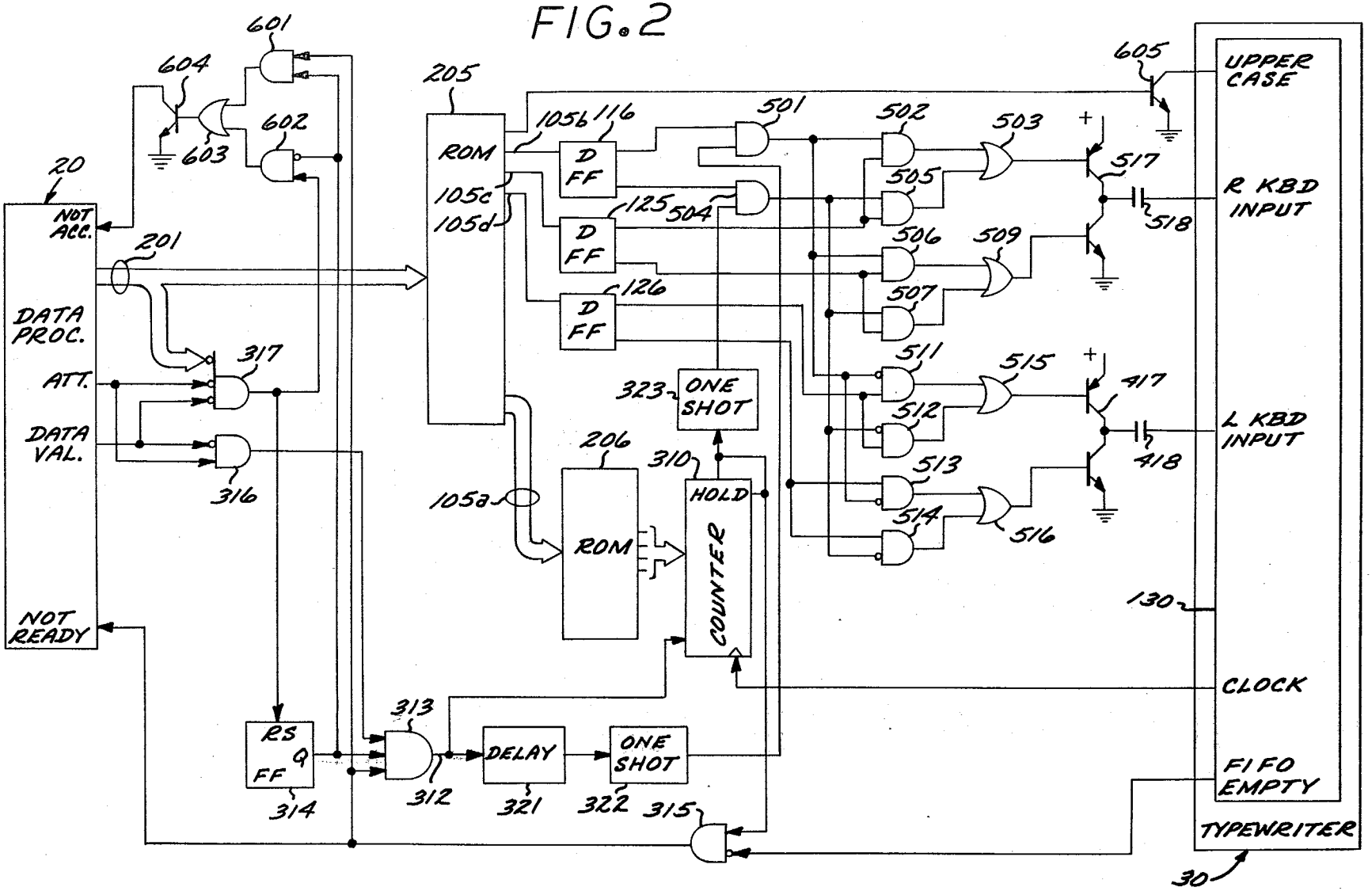
FIG. 2 is a detailed diagram conformed for use with parallel coding of alphabetical characters.

The foregoing general implementation may be variously carried out, one example thereof being shown in FIG. 2. In this figure, the interface is arranged for accepting parallel data from an eight bit wide data bus. This data bus, shown as bus 201, originates in a data processor 20 and is applied to the address terminals of an encoder ROM shown herein as an eight by eight encoder ROM 205 which responds in a unique eight bit code for each eight bit address. Four bits of the code outputs of ROM 205 are applied as an address input to yet another ROM 206 which, in turn, converts these four bits to a set of jam or preset inputs to a counter 310. Thus ROMS 205 and 206 provide the encoding function attributed to the encoder ROM 105 hereinabove with the input to ROM 206 forming the timing signal 105*a*. ROM 205, furthermore, provides the additional three output signals 105*b*, 105*c*, and 105*d* to a set of D flip flops 116, 125 and 126 which act as the aforementioned right/left first memory 116, the left polarity memory 125, and the right polarity memory 126. The signals from the aforementioned flip flops 116, 125 and 126 are then applied to a pulse steering logic arrangement controlled by the terminal count from the timer stage 110. More specifically, this timing function is provided by the eight bit preset counter 310 clocked by the clock output of the typewriter 30. These preset inputs to counter 310 are the above-mentioned jam inputs from ROM 206. Counter 310 is strobed for parallel loading by a print pulse signal 312 which originates at the output of an AND gate 313 connecting the Q output of an RS flip flop 314 with the output of yet another AND gate 315 and an AND gate 316. AND gate 315, in turn, collects the inverted output of the fifo stack within the LSI chip 130 with the terminal count output of the counter 310, while the AND gate 316 collects the data valid check signal and the attention signal originating in the data processor 20. In addition, a further AND gate 317 collects the inverted first four bits of data on the data bus 201 with the inverted attention and data valid signal thus acting as an address filter for selecting the typewriter 30. The output of AND gate 317 is connected to set the aforementioned RS flip-flop 314. Thus the output of AND gate 317 will go high and will stay high upon the proper combination of data check, appropriate data bit code on the first four lines of the bus 201, and the completion of the attention signal. This, in summary, accomplishes the function of engaging this peripheral I/O, checking for error and establishing data on the bus 201. Once this combination is achieved, the appropriate signal input is available to AND gate 313 to produce a leading edge signal for the flip flops 116, 125, and 126 which then controls the pulse steering. This same print pulse signal or output signal from AND gate 313, shown herein as signal 312, is then applied to a delay stage 321 inserted at this point to accomodate various skews or timing problems. The output of the delay stage 321 then sets off a one-shot 322 forming the above-mentioned function of the leading edge multivibrator 111. One shot 322 then strobes the appropriate gate 501–507, 509 in the pulse steering logic 115 to enable two outputs to a push-pull circuit 517 which through a capacitor 518 generates the right polarity pulse to the typewriter 30 as the proper clock instance, thus operating as the right polarity stage 117.

A second push-pull circuit 417 in series with a capacitor 418 provides the function of the left polarity stage 118 thus duplicating the left end acoustic signal of the acoustic bar within the typewriter 30. It is to be understood that the attention and data valid signal occur in the data processor 20 as a matter of course. It is the customary convention to include various error checks within any data processing device and the attention signal is usually available for any peripheral system.

The steering logic 115, once again, may be variously implemented. As an example, the Q output of flip-flop 116 may be connected to the input of an AND gate 501 which also collects the signal 312 as delayed by one shot 321 and shaped by one shot 322. The output of AND gate 501 will thus be high at the beginning of the count, indicating a right first signal combination. This output may be combined with the Q output from flip flop 125 at an AND gate 502 which thus form a left-first-positive signal configuration, simulating a right first arrival of a compression wave. This signal may be applied, through an OR gate 503, to the positive side of push pull circuit 517. The $\overline{Q}$ output of flip flop 116 may be combined with the signal from the trailing edge one shot 323 at an AND gate 504 which provides its output for combination with the Q output of flip flop 125 at an AND gate 505 which then drives the other input of OR gate 503. Another set of AND gates 506 and 507 combine the outputs of AND gates 501 and 504 with the $\overline{Q}$ output of flip flop 125 to drive, through an OR gate 509, the negative side of the push pull circuit 517.

By similar arrangement the left polarity is resolved. More specifically, the output of AND gate 501 is applied to an inverting input of two AND gates 511 and 513 which at their other inputs respectively receive the Q and $\overline{Q}$ output of flip flop 126. The inverted output of AND gate 504 is similarly combined with these Q and $\overline{Q}$ signals at AND gates 512 and 514. AND gates 511 and 512 are combined at an OR gate 515 driving the positive side of the push pull circuit 417 while the AND gates 513 and 514, through an OR gate 516, drive the negative side.

Thus push pull circuits 417 and 517, through the appropriate capacitors 418 and 518, simulate the wave fronts at the times selected by counter 310 and signal 312. Accordingly, the signals therefrom may be wholly substituted for the keyboard signals of this typewriter 30.

While the foregoing sets out the operational arrangement of a system transforming conventionally coded, parallel character data, it is to be understood that various additional housekeeping functions are entailed. For example, the data valid signal may be combined with the Q outputs of the RS flip flop 314 and the output of OR gate 315 at an AND gate 601. Concurrently, the outputs of AND gate 317 may be combined with the inverted Q output of flip flop 314 at an AND gate 602, the outputs of AND gates 601 and 602 being collected at an OR gate 603 set to base bias a transistor 604 which by its collector is tied, once again, to the data processor 20. This connection effectively suppresses any further data transfer on bus 201, allowing for sufficient time for executing the previous character command. Furthermore, since only three bits of data are necessary to operate the flip flop or memory stages 116, 125 and 126 a fourth bit is available to drive a transistor 605 which may provide the necessary grounding input by which the upper case characters are distinguished within the typewriter 30.

It is to be further understood that the various AND gates 316, 317, flip flop 314 and the other logic are principally set up to provide the buffering function between the two system rates. Should one desire a memory arrangement built around a RAM may be implemented to accomplish the same function. This latter approach would be more appropriate for configurations where the data processor bus time is more closely controlled.

Figure 3:
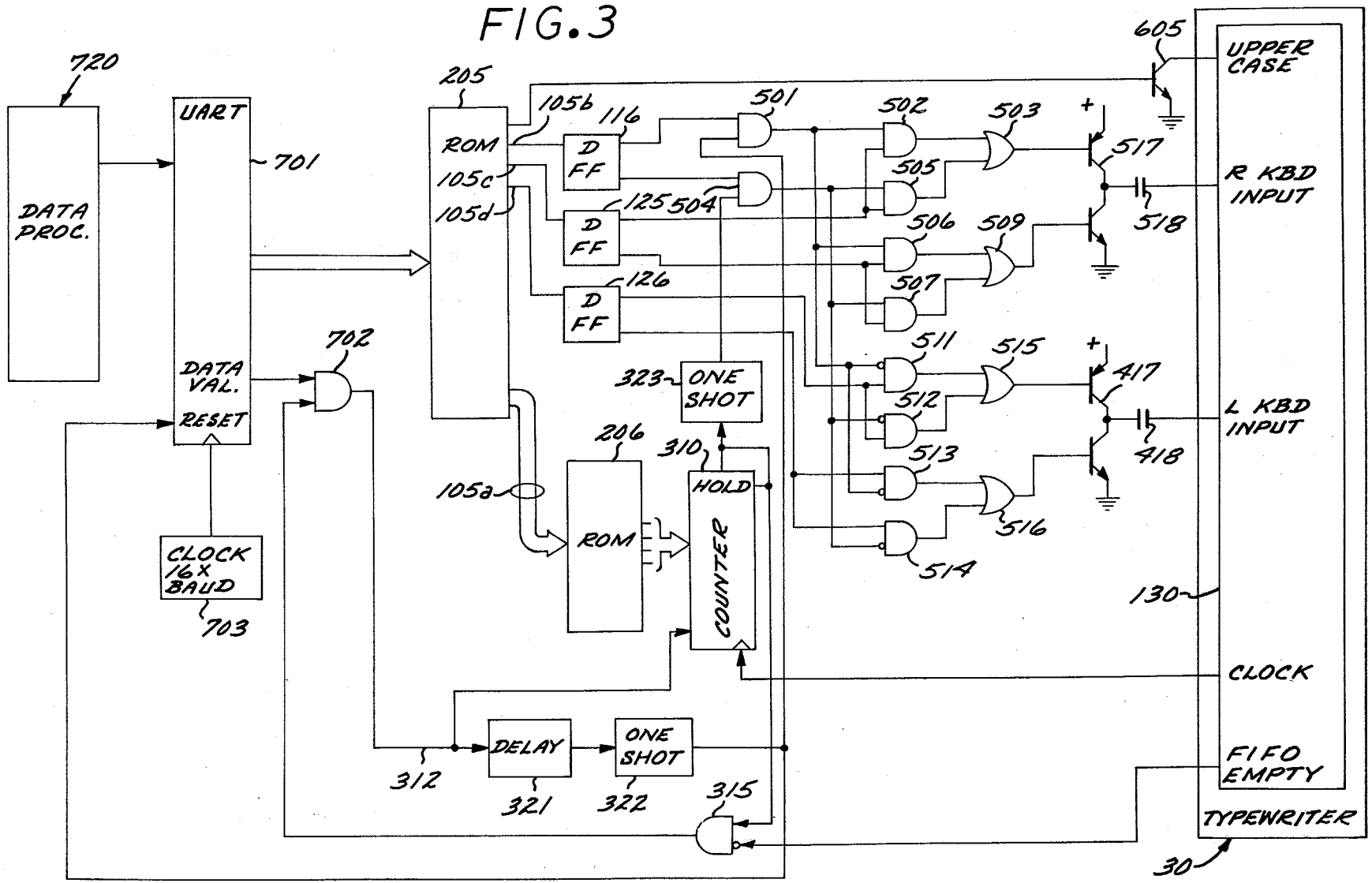
FIG. 3 is a circuit detail conforming the interface for use with serially coded data.

As a further alternative, and more particularly for use with serial data streams, one may implement the foregoing buffering function through a universal asynchronous receiver-transmitter shown in FIG. 3. More specifically, as shown in this figure a UART 701 receives the serial output from a data processing device 720 conformed as a narrow width bus device requiring serial data communication. This UART 701 provides the necessary parallel data conversion which then is applied to the address terminal of ROM 205 and is reset by the output of the one shot 322. In addition a data available signal may be combined with the output of AND gate 315 in an AND gate 702 to produce the necessary print pulse signal shown as signal 312 in FIG. 2 which is then fanned out to the delay 321, the parallel load input of counter 310 and the latch inputs to the flip flop stages 116, 125 and 126. As is customary, the UART 701 may be clocked by a 16 times baud clock input 703.

According to the foregoing description a scheme is set out which can either take serial or parallel standard code data and convert it to the time increment and pulse polarity necessary to duplicate the acoustic bar of the Typetronic typewriter 30. This conversion is achieved through the use of the counter 310 preset for the appropriate aperture by the jam inputs from ROM 206 which, in turn, is addressed by the four bits of output of ROM 205. The remaining four bits of ROM 205 sets the polarity.

Since the alternatives set forth hereinabove accomodate data processing devices of various configurations one skilled in the art may select the necessary option as the particular device is selected. While one may refer to the various maintenance and descriptive manuals for the Typetronic typewriter from the SCM Corporation the teachings of U.S. Pat. No. 4,258,356 set forth the necessary bases for the operation of a multiple acoustic bar arrangement. This arrangement, as well as the commercially sold article, may be conveniently accomodated by expansion of these principles.

Some of the many advantages of the present invention should now be readily apparent. The invention allows for the advantages available in the aforementioned Typetronic typewriter while at the same time accomodating standardized character data code in a convenient interface package. Thus all of the keyboard advantages obtained remain with the user while the additional feature of a printer peripheral is rendered available.

Obviously many modifications and changes may be made to the foregoing description without departing from the spirit of the invention. It is therefore intended that the scope of the invention be determined solely on the claims appended hereto.

What is claimed is:

1. Apparatus for adapting an acoustic bar operated typewriter mechanism for use as a printer responsive to standardized data processing code, comprising:

an encoder memory connected to receive said data processing code and conformed to provide a responsive first and second output signal having a unique correspondence in digital code to each said data processing code;

timing means connected to receive said first output signal for producing a leading and trailing edge pulse separated by a time interval corresponding to the code of said first output signal;

steering means connected to receive said leading and trailing edge pulses and said second output signal for producing a first and second direction signal at said leading and trailing edge pulses; and simulating means connected to receive said direction signals for converting thereof to acoustic signals connected to said typewriter mechanism.

2. Apparatus according to claim 1 wherein: said data processing code is in parallel form.

3. Apparatus according to claim 1 wherein: said data processing code is in serial form.

4. Apparatus according to claim 3 further comprising: converting means interposed between said data processing code and said encoder memory for converting said data processing code into parallel form.

* * * * *